US012642322B2

(12) United States Patent
Lee

(10) Patent No.: US 12,642,322 B2
(45) Date of Patent: Jun. 2, 2026

(54) CONTINUOUS STRAND FOR WIG, WHICH INCLUDES MULTIPLE FILAMENTS AND IN WHICH INCLINED THICKNESS SECTION IS REPEATEDLY FORMED ALONG LENGTHWISE DIRECTION THEREOF, AND WIG MANUFACTURED USING SAME

(71) Applicant: Hae Ju Lee, Seoul (KR)

(72) Inventor: Hae Ju Lee, Seoul (KR)

( * ) Notice: Subject to any disclaimer, the term of this patent is extended or adjusted under 35 U.S.C. 154(b) by 562 days.

(21) Appl. No.: 18/171,456

(22) Filed: Feb. 20, 2023

(65) Prior Publication Data

US 2023/0200476 A1 Jun. 29, 2023

Related U.S. Application Data

(63) Continuation of application No. PCT/KR2021/011155, filed on Aug. 20, 2021.

(30) Foreign Application Priority Data

Aug. 20, 2020 (KR) ..... 10-2020-0104806

(51) Int. Cl.
*A41G 3/00* (2006.01)
*D02G 3/28* (2006.01)
*D02G 3/34* (2006.01)

(52) U.S. Cl.
CPC ..... *A41G 3/0083* (2013.01); *D02G 3/288* (2013.01); *D02G 3/34* (2013.01); *D10B 2503/08* (2013.01)

(58) Field of Classification Search
CPC ..... A41G 3/0083; D02G 3/34; D02G 3/288; D02G 3/28–30; D02G 3/24
See application file for complete search history.

(56) References Cited

U.S. PATENT DOCUMENTS 3,910,291 A 10/1975 Kim
4,010,601 A * 3/1977 Anahara ..... D02G 1/024 57/283

(Continued)

FOREIGN PATENT DOCUMENTS

CN 1901820 A 1/2007
CN 200994529 Y 12/2007

(Continued)

OTHER PUBLICATIONS

Pastore, Christopher M. Ayranci, Cagri Ko, Frank K.. (2023). Textile Structural Composites. DEStech Publications. Retrieved from <br>https://app.knovel.com/hotlink/toc/id:kpTSC00002/textile-structural-composites/textile-structural-composites (Year: 2023).*

(Continued)

*Primary Examiner* — Larissa Rowe Emrich
(74) *Attorney, Agent, or Firm* — Guntin & Gust, PLC; Miyoung Shin

(57) ABSTRACT

A continuous strand includes a pencil normal (PN) section, two first pencil tapering (PT) sections, two second PT sections, and two pencil connection (PC) sections. The pencil normal (PN) section extends along a longitudinal direction thereof and having a first cross-sectional area of a constant size. The two first pencil tapering (PT) sections are tapered in such a way that cross-sectional areas decrease. Two second PT sections are tapered in such a way that the decreased cross-sectional areas increase again. The two pencil connection (PC) sections connect a first PT section and a second PT section that are adjacent to each other, and have a second cross-sectional area of a constant size. The continuous strand may implement a multi step-pencil tapering (MS-PT) effect that presents significantly improved aesthetic characteristics for a wig, without resorting to a labor-intensive manual operation.

18 Claims, 5 Drawing Sheets

(56) References Cited

U.S. PATENT DOCUMENTS

| | | | | |
|---|---|---|---|---|
| 4,144,703 | A * | 3/1979 | Ingham, Jr. | D02G 3/34 57/409 |
| 8,025,065 | B2 | 9/2011 | Guliker | |
| 2006/0024497 | A1 * | 2/2006 | Fujiwara | A41G 3/0083 428/364 |
| 2020/0054086 | A1 | 2/2020 | Mayer | |

FOREIGN PATENT DOCUMENTS

| | | | |
|---|---|---|---|
| CN | 207428501 | U | 6/2018 |
| CN | 110089794 | A | 8/2019 |
| JP | 5075289 | | 8/2012 |
| KR | 20180070536 | A | 6/2018 |
| KR | 20190087335 | A | 7/2019 |
| KR | 20190087336 | A | 7/2019 |
| WO | 2020075714 | A1 | 4/2020 |

OTHER PUBLICATIONS

Chinese Office Action for Corresponding Chinese Patent Application No. 202180011989.4, issued Nov. 30, 2024 (6 pages).
Intl Search Report for PCT/KR2021/011155 mailed Dec. 1, 2021, 5 pp.
Written Opinion for PCT/KR2021/011155 mailed Dec. 1, 2021, 3 pp.

* cited by examiner

CONTINUOUS STRAND FOR WIG, WHICH INCLUDES MULTIPLE FILAMENTS AND IN WHICH INCLINED THICKNESS SECTION IS REPEATEDLY FORMED ALONG LENGTHWISE DIRECTION THEREOF, AND WIG MANUFACTURED USING SAME

CROSS-REFERENCE OF RELATED APPLICATION AND PRIORITY

The present application is a continuation of PCT Application No. PCT/KR2021/011155 filed Aug. 20, 2021, which claims priority to Korean Patent Application No. 10-2020-0104806 filed Aug. 20, 2020, the entire disclosure of which are incorporated herein by reference in their entirety.

TECHNICAL FIELD

The present disclosure relates to a continuous strand for a wig including a plurality of filaments, and a wig made therefrom. Specifically, the present disclosure relates to a continuous strand for a wig, and a wig made therefrom, the continuous strand having gradient thickness sections, that is, so-called sharp 'pencil tapering (PT) sections' or a so-called non-aligned effect at regular or irregular intervals along a longitudinal direction.

BACKGROUND

Important characteristics required for wigs (including wigs for dolls) are beauty (aesthetic features), convenience, and economic efficiency. Among the beauty characteristics, although there may be some differences depending on a change of fashion and region, there is a pencil tapering shape effect (PTE) (so-called non-aligned effect), which may produce a volumed-up characteristic of an upper part of a wig connected to a real hair of a wearer, a neat alignment of a lower part farthest from the scalp of a wearer, and along with these characteristics, naturalness of the whole style.

The term 'non-aligned', commonly used in the art, means non-alignment. This term is used to characterize a process carried out in a wig factory to obtain an effect of, an inclined-thickness of a strand for a wig resulting from a decrease in a cross-sectional area due to a decrease in a number of filaments included in the strand along the inclined-thickness (longitudinal direction=X axis), i.e., a pencil tapering (PT) effect, which refers to an inclined-thickness of a tapered end portion of a pencil where the pencil lead is exposed. To explain it in more detail, hair styles being pursued today make hair ends have gradient lengths (variable lengths) in a V-shape, without making lengths of the hair the same, by trimming the hair ends using thinning scissors or the like. As a result, a naturally refined and neat hairstyle can be obtained. That is, a volumed-up upper part of the hair and a neatly aligned lower part of the hair are being pursued.

Wigs made of human hair are expensive products and are produced by small-scale production, and human hair itself exhibits gradient length characteristics in a process of collecting human hairs. In a case of special wigs for baldness, since the wigs are produced in small quantities, a gradient length may be created by using thinning scissors on each of the wigs. However, wigs for blacks, which account for about 90% of the global wig demand, are mostly made of synthetic fibers. When mass-production is required as in the case, it is very difficult in terms of costs to use thinning scissors on all filaments (usually monofilaments) for commercialization, in order to generate a PT effect during a manufacturing process of synthetic fiber wigs. Specifically, roughly cut filaments of the same length are combed by using a hackle (a type of a large comb), and the filaments slide to both directions along the longitudinal direction, to make a non-alignment state, and the center portions of these filaments (based on the longitudinal direction) are folded in half, creating a gradient length effect originating from the center portions that are connected to the scalp when worn, and as such, simplification of production processes is attempted. The PT effect that may be obtained this way is commonly referred to as "non-aligned effect". There is currently a growing tendency to make the ends of the filaments appear sharper. For example, recently, a sharper PT effect is created by two-step non-alignment, which is obtained by a non-alignment process of placing filaments having two different length groups such that their center portions based on the longitudinal direction are overlapped, and combing the filaments using a hackle. Furthermore, multi-step non-alignment (which may also be referred to as 'multi step-pencil tapering (MS-PT) sharpness'), for example, 3-step (long hair, medium hair, short hair) non-alignment, is also emerging.

This trend is also spreading to items used to produce wigs, and even the most basic item of wigs for blacks, a regular not-unaligned braid (braid without a tapered PT section) is in a trend to be substituted with a non-aligned braid (also referred to as a pre-stretched braid in the art). The term "not-unaligned braid" refers to a braid not having a PT effect by hackle non-alignment, that is, a braid not having a gradient length effect. End consumers take certain amounts of not-unaligned braids (subdivision) and produce a slight PT effect by a non-professional manual operation (stretching by fingers).

As described above, producing a PT effect by a non-alignment operation is labor-intensive, requiring a lot of time and effort, and skill is indispensably required to obtain a uniform symmetrical effect. In composite strand products obtained through this non-alignment operation, filaments (usually monofilaments) included in the PT section stick out (protrude), and therefore, end locking becomes unstable and not beautiful. In addition, since a number of filaments gradually decreases in a lower end of the PT section, drapability of the finished strand is poor after braiding or twisting. That is, the strand does not feel wrapped around the wearer's body line, and gives an unstable feeling as if the strands are fluttering.

In addition, the PT effect obtained by existing hackle non-alignment causes fine hairs to protrude at lower ends of a box braid and a Senegal twist, which are finished products, worn after braiding and twisting the braid product, against the purpose of pursuing neatly aligned sharpness at lower ends of the strand. In order to solve this issue, end consumers or hairdressers do a separate trimming operation to sink fine hairs by immersing the strand in hot water, but depending on a type of filaments, fine hairs do not settle at all, as in a case of polypropylene (PP) filaments, making it difficult to prevent a messy state in which the filaments at the lower ends look entangled with each other.

In addition, non-alignment obtained by using a hackle may impede beauty characteristics because symmetry of the non-alignment is not uniform when an elaborate operation is not performed, and labor proficiency has a great impact on product quality, and since the process is the most labor-intensive in mass production, production costs are also greatly affected by the process. For special braids such as grouped textured strands on which hackle non-alignment may not be performed, a method other than the hackle non-alignment must be found to obtain MS-PT.

Hot water straightening (HWS) of filaments, which is performed to organize fine hairs protruding from lower ends of a strand, makes protruding fine hairs (filaments) stretch in a longitudinal direction and become even, and thus a beautifying effect may be obtained. However, since a texture imparted to the filaments in the strand is also stretched at the same time, porosity obtained by the texture is lowered and a bulk density is increased. Accordingly, bulkiness (lightness) may be damaged, thereby negatively affecting economic efficiency, convenience, and beauty from other perspectives. That is, there are issues of increased costs for obtaining a coverage volume necessary for a consumer to produce a hair style, and increased load applied to the scalp as a weight per unit volume, that is, a bulk density increases. Depending on polymer components constituting the filaments, HWS does not occur, and only some types of polymer filaments may achieve an HWS effect. In particular, most of the filaments made of a highly crystalline polymer are difficult to obtain the HWS effect.

For special braids, that is, finished braids configured to have a certain function, the filaments are non-aligned and subdivided (a certain portion is weighed and removed) before making these special braids, to create a style. Some special braids have a strong kinky texture, or the strand is thick with bound filaments, and thus it is impossible to perform a hackle process itself, and the PT effect cannot be obtained. Special braids in vogue today also pursue the PT effect.

As may be seen from Korean Patent Registration No. 2078793 by the present inventor, existing continuous kinky spiral strands in the art have an inherent tapering effect, but there is a shortcoming in that an MS-PT (i.e., smooth & long tapering) effect for producing an active aesthetic effect cannot be produced. In particular, for a strand in which filaments are bound, when a cross-section is flat, that is, when the cross-section is rectangular, there is no inherent tapering, and even when the cross-section is circular, in a case the binding strand is of a cylinder form having a smooth surface in which rotational force applied during a manufacturing process is not visible (i.e., showing no tornado effect), the inherent tapering effect is insignificant, and there are great limitations in producing wig products with aesthetic features.

In addition, there is a demand for continuous filament strands that produce a partially different feeling.

In addition, in various industries other than wig industry, continuous strands are manufactured through braiding or twisting and applied to products such as ropes. However, in the wig industry, such products give a dull feeling as if a rope with no aesthetic value were hung on the head. Therefore, in the wig industry, until now, there has been no choice but to commercialize products by giving a gradient length effect by a manual operation called non-alignment. Moreover, a trend of extending pencil tapering sections, and pursuing the so-called two-step, and three-step manual non-alignment is spreading. Since this trend is spreading worldwide, an alternative continuous strand for wigs that may efficiently achieve aesthetic effects required in the market is required.

SUMMARY

Therefore, an object of the present disclosure is to provide a continuous strand for a wig with excellent aesthetic features, which may implement an MS-PT (smooth & long tapering) effect that has become very important among beauty characteristics, without resorting to a labor-intensive manual operation, and in which there is no or minimized protrusion of filaments in end portions of a simple strand formed by rotational twisting, and a complex strand (which may typically be formed by braiding and/or cross-twisting of simple strands), without depending on a gradient length effect (an effect in which filaments have different lengths in a longitudinal direction of the strand from a base line).

Another object of the present disclosure is to provide a continuous strand for a wig with excellent aesthetic features, which may implement a multi-step pencil tapering effect (PTE) (so-called non-aligned effect) without resorting to a labor-intensive manual operation and has no or minimized filament protrusion at ends portion of the strand.

Another object of the present disclosure is to provide a continuous strand for a wig in which pencil tapering (PT) sections are formed repeatedly and symmetrically in a longitudinal direction (that is, X direction, or machine direction (MD)), the PT sections having a pencil tapering effect due to impartation of partial variation patterns at regular intervals or gradients in size (that is, a thickness, width, or cross-sectional area).

Still another object of the present disclosure is to provide a continuous strand for a wig in which PTE is implemented by lowering bulkiness through reducing a degree of shrinkage freedom of the filaments in a gradient along a longitudinal direction of the strand and tapering the strand in a section where PTE is wanted.

Still another object of the present disclosure is to provide a wig using the continuous strand for a wig.

In order to solve at least one of the technical problems related to the continuous strand for a wig described above, an aspect of the present disclosure provides a continuous strand for a wig which is extended in the longitudinal direction thereof, wherein the continuous strand is in a form of: a simple strand that has an appearance formed by rotational twisting produced by rotations of a plurality of filaments and is extended in the longitudinal direction; or a composite strand that has an appearance formed by cross-twisting by revolutions of a plurality of the simple strands, and/or braiding and is extended in the longitudinal direction, the simple stand; and each of the simple strands constituting the composite strand includes 40 to 4,000 filaments of one type or two or more types, wherein each of the filaments includes an amorphous organic polymer, a semi-crystalline organic polymer, or a polymer alloy thereof, each of the simple strand and the composite strand has at least one cross-sectional shape selected from: a circular shape; oval shape; or a polygonal shape selected from a triangle, a quadrangle, and a pentagon, when the cross-section is a circle or an oval, a diameter or longest diameter thereof is in a range of 0.2 cm to 3.0 cm, and when the cross-section is a polygon, a length of at least one side of the polygon is in a range of 0.2 cm to 3.0 cm, each of the simple strand and the composite strand includes: a pencil normal (PN) section extending along the longitudinal direction and having a first cross-sectional area of a constant size; two first pencil tapering (PT) sections respectively extending from both ends where the PN section ends and are tapered in such a way that cross-sectional areas decrease; two second PT sections respectively extending from ends of the two first PT sections having decreased cross-sectional areas and are tapered in such a way that the decreased cross-sectional areas increase again; and two pencil connection (PC) sections (connecting sections of PT-PN-PT repeating unit sections) connecting the first PT section and the second PT section that are adjacent to each other, and having a second cross-sectional area of a constant size, when a section of bilateral symmetry consisting of the PN section and the two first PT sections respectively linked to both ends of the PN section is set as one cycle, each of the simple strand and the composite strand repeatedly includes two or more multiple cycles, each of the one cycles which are adjacent to each other is connected by the PC section, the first cross-sectional area is larger than the second cross-sectional area, when a part of the one cycle, having only one first PT section and including all or part of the PN section of the one cycle, is cut to separate the part of the one cycle from each of the simple strand and the composite strand, and when lengths of the filaments separated in this manner are measured in the longitudinal direction while maintaining textures and waves imparted to the separated filaments, a difference Ld between a length of the longest filament Lmax and a length of the shortest filament Lmin, and a length Lpt of the first PT section included in the part of the separated one cycle are not equal to each other.

In an embodiment, each of cross-sectional areas of the PN sections included in the center of each one cycle included in the two or more multiple cycles may be the same as or different from each other.

In an embodiment, when a part of the one cycle, having only one first PT section and including all or part of the PN section of the one cycle is cut to separate the part of the one cycle from each of the simple strand and the composite strand, and when lengths of the filaments separated in this manner are measured in the longitudinal direction while maintaining textures and waves imparted to the filaments, the filaments may have the same or substantially the same length with each other.

In an embodiment, when the PN section, the first PT sections, or the second PT sections are respectively cut to separate them from each of the simple strand and the composite strand, and straight lengths of the filaments are measured in the longitudinal direction while maintaining textures and waves imparted to the filaments, the lengths of the filaments in each section thus separated may be the same or substantially the same as each other; 1 or the filaments in each section thus separated may have 2, 3, or 4 length groups different from each other.

In an embodiment, as at least one of the rotational twisting, the cross-twisting, and the braiding acting on a unit length of each of the simple strand and the composite strand increases, gradient tension increasing in a direction perpendicular to the longitudinal direction is applied to each of the simple strand and the composite strand, and due to a resulting shrinkage control effect, each of the simple strand and the composite strand may have gradient cross-sectional areas that decrease toward tips of the first and second PT sections and become thinner.

In an embodiment, a plurality of the first and second PT sections connected to a plurality of the PN sections are produced by gradient shrinkage (GS) of the filaments in the longitudinal direction, and due to the gradient shrinkage, at least one of the following may be expressed: gradient thickness (GT) or gradient denier (GD) in which a thickness (denier) of the filaments decreases in the first PT section and increases in the second PT section along the longitudinal direction; and gradient porosity (GP) in which porosity, which is a void volume ratio existing between the filaments, decreases in the first PT section and increases in the second PT section along the longitudinal direction.

In an embodiment, the plurality of first and second PT sections connected to the plurality of PN sections are produced by gradient shrinkage (GS) of the filaments in the longitudinal direction, and due to the gradient shrinkage, only the gradient thickness (GT or gradient denier (GD)) of the filaments may be expressed such that a thickness (denier) of the filaments may decrease in the first PT section and increase in the second PT section along the longitudinal direction.

In an embodiment, the plurality of first and second PT sections connected to the plurality of PN sections may be produced by gradient shrinkage (GS) of the filaments in the longitudinal direction, and, only gradient porosity (GP) may be expressed such that, porosity, which is a void volume ratio existing between the filaments, may decrease in the first PT section and increase in the second PT section along the longitudinal direction.

In an embodiment, a sum of rotational twistings, cross-twistings, and braidings acting on a unit length of each of the simple strand and the composite strand at the tips of the first and second PT sections may be 1.2 times to 5.5 times, preferably 1.5 times to 4.0 times greater than a sum of rotational twistings, cross-twistings, and braidings acting on a unit length of each of the simple strand and the composite strand in the PN section (excluding rubbing locks (RLs), cross-twisted locks (CTLs), and braiding locks (BLs) portions formed at the tips of the first and second PT sections).

In an embodiment, a porosity of the PN section and the first and second PT sections is calculated as a ratio of real density to bulk density (RD/BD), the RD/BD ratio of the PN section is 1.5 to 30, preferably 3 to 30, 2 to 20, 5 to 15, or 7 to 20, and the RD/BD ratio of the PN section may be 1.2 times to 10 times, preferably 1.5 times to 4 times, 1.5 times to 10 times, 1.8 times to 8 times, or 1.8 times to 5 times greater than the RD/BD ratio of the first and second PT sections (excluding rubbing lock, cross-twisted lock, and braiding lock portions formed at the tips of the first and second PT sections).

In an embodiment, the PN section may show a three-dimensional shape of a cylinder, an elliptical cylinder, a rectangular prism, or a pentagonal prism, and the first and second PT sections may show a three-dimensional shape of a truncated cone having a circular cross-section of the cylindrical PN section as a base, an elliptical truncated cone having an elliptical cross-section of the PN section having an elliptical cylinder shape as a base, a frustum of quadrangular pyramid having a rectangular cross-section of the PN section having a rectangular prism shape as a base, or a frustum of pentagonal pyramid having a pentagonal cross-section of the PN section having a pentagonal prism shape as a base.

In an embodiment, in a side view of the first and second PT sections, a center line formed by connecting in the longitudinal direction, a midpoint of a line segment, which indicates a base side of the truncated cone, the elliptical truncated cone, the frustum of quadrangular pyramid, or the frustum of pentagonal pyramid, to a midpoint of a line segment, which indicates an upper side of the truncated cone, the elliptical truncated cone, the frustum of quadrangular pyramid, or the frustum of pentagonal pyramid, forms an angle with any one of hypotenuses of the truncated cone, the elliptical truncated cone, the pentagonal pyramid, the frustum of quadrangular pyramid, or the frustum of pentagonal pyramid, of 0.3° to 45° (for example, 0.3° to 30°, 0.5° to 25°, 1° to 25°, or 1.5° to 25°), and in the side view of the first and second PT sections, a length of the center line formed by connecting the midpoint of the line segment indicating the base side of the first and second PT sections to the midpoint of the line segment indicating the upper side may be 1 cm to 50 cm.

In an embodiment, the decrease in the cross-sectional area in the first PT section is a result of a decrease in porosity between the filaments constituting each of the simple strand and the composite strand and/or a decrease in a thickness of the filaments, and in the first and second PT sections, each of the simple strand and the composite strand may have a solid form in which the center portion is not empty, not a hollow form in which the center portion is empty.

In an embodiment, the continuous strand may be axisymmetric relative to a virtual line cutting in a direction perpendicular to the longitudinal direction at a midpoint of the PN section.

In an embodiment, each of the simple strand and the composite strand may have a length of 1 m or more. In an embodiment, each of the filaments preferably has a thickness of 30 denier to 180 denier.

In an embodiment, a length of the PN section may be in a range of 5 cm to 200 cm, lengths of each of the first and second PT sections may be in a range of 1 cm to 50 cm, and a length of the PC section may be in a range of 0.3 cm to 5 cm.

In an embodiment, each of the simple strand and the composite strand may be in a form that is cut to a predetermined length in a direction perpendicular to the longitudinal direction.

In an embodiment, each of the simple strand and the composite strand may consist only of filaments made of one type of polymer components selected from an amorphous organic polymer, a semi-crystalline organic polymer, or a polymer alloy thereof.

Another aspect of the present disclosure provides a wig including any one of the above-described continuous strands for a wig, in order to solve the technical problems related to wigs.

When a hackle non-alignment method in the art for obtaining a PT effect by a manual operation is used, filaments protrude like fine hairs at ends of the strand, so HWS operation has been required to trim the same. By the HWS operation, protruding fine hairs are stretched in the end direction, and an effect of tidiness may be obtained, however, textures imparted to the strand also stretch, and volume properties (bulkiness, lightness) are damaged, and as a result, the HWS operation is likely to have a negative impact on economic efficiency and convenience. On the other hand, in a case of a continuous strand for a wig of the present disclosure, a PT effect of a new paradigm may be produced with no or minimal filaments protruding and no damage to the texture and bulkiness (volume properties), while producing sharpness of the end of the PT section. That is, when the continuous strand for a wig according to the present disclosure is used, there is substantially no filament protruding, and a stable drapability may be obtained by giving a similar weight in the end portion of the PT section to that in the middle portion, and since the PT effect is made symmetrically in the longitudinal direction (that is, machine direction (MD)) and cross machine direction (CMD) perpendicular thereto, locking may be finished very stably. Therefore, when using the strand for a wig according to the present disclosure, the PT effect of a new paradigm may be produced with substantially no protruding fine hairs, without damaging texture and bulkiness (volume properties), while producing sharpness of the lower end of the strand (opposite side of the scalp).

In addition, up to date, a method of attaching braids with a crochet needle along a support called cornrows has been in vogue, and thus, most special braids must form a pre-loop on an upper part. Consumers have to do crochet braiding when wearing these special braids, but since special braid products using the strand according to the present disclosure is a continuous strand that is repeated in a symmetrical structure, a number of crochet braiding required for wearing special braids may be reduced in half, and as it is possible to cut the continuous strand to a desired length and use the same, consumers' preference range (needs window, range of needs) may be met to a larger extent.

By using the continuous strand for a wig of the present disclosure, a sharp PT (MS-PT) effect, which is a beauty characteristic strongly required in the wig industry and hair care industry recently, may be effectively imparted, so a value of the strand products may be maximized, and during the labor-intensive wig manufacturing processes, the PT effect may be obtained without going through a non-alignment process that requires considerable labor and costs.

In the case of imparting a non-aligned effect through existing manual hackle non-alignment, for simple strands formed by rotational twisting produced by rotation of filaments, composite strands formed by cross-twisting by revolution of the two strands in the opposite direction (two strands are interlaced and twisted with each other), or composite strands in which three strands are braided, filaments included therein protrude to the outside in the manufacturing process due to differences of lengths, and look untidy and messy. In addition, since a PT section in the ends of the strand is a section where a number of filaments gradually decrease, drapability of braid products obtained by braiding or twisting of the filaments in the strand is deteriorated. That is, the braid product does not feel wrapped around the wearer's body line and causes a sense of instability as if the product is fluttering. In addition, existing simple strand and composite strand products lack uniformity of symmetry in a direction perpendicular to the longitudinal direction, and thus end-locking is unstable, resulting in poor long-term usability and poor end aesthetics. On the other hand, in a case of a braid product using the continuous strand according to the present disclosure, there is no or minimized protrusion of filaments, and as a weight similar to that in the middle section is imparted at the end of the PT section, stable drapability may be obtained, and a symmetrical PT effect may be obtained in the longitudinal direction and a direction perpendicular thereto. Therefore, the strand of the present disclosure is very stable in locking and does not come loose at the end, and thus, has excellent long-term usability and a neat finish at the end, resulting in increased aesthetic values.

DETAILED DESCRIPTION

Hereinafter, the present disclosure will be described in more detail with respect to a continuous strand for a wig and a wig including the same according to various example embodiments of the present disclosure. However, the description below is for illustrative purposes only. Therefore, it will be clear to those with average knowledge in the art to which the present disclosure belongs that the embodiments may be modified and altered in various ways. In describing the present disclosure, detailed descriptions of related known functions or configurations are omitted in order not to obscure the gist of the present disclosure.

Figure 1:
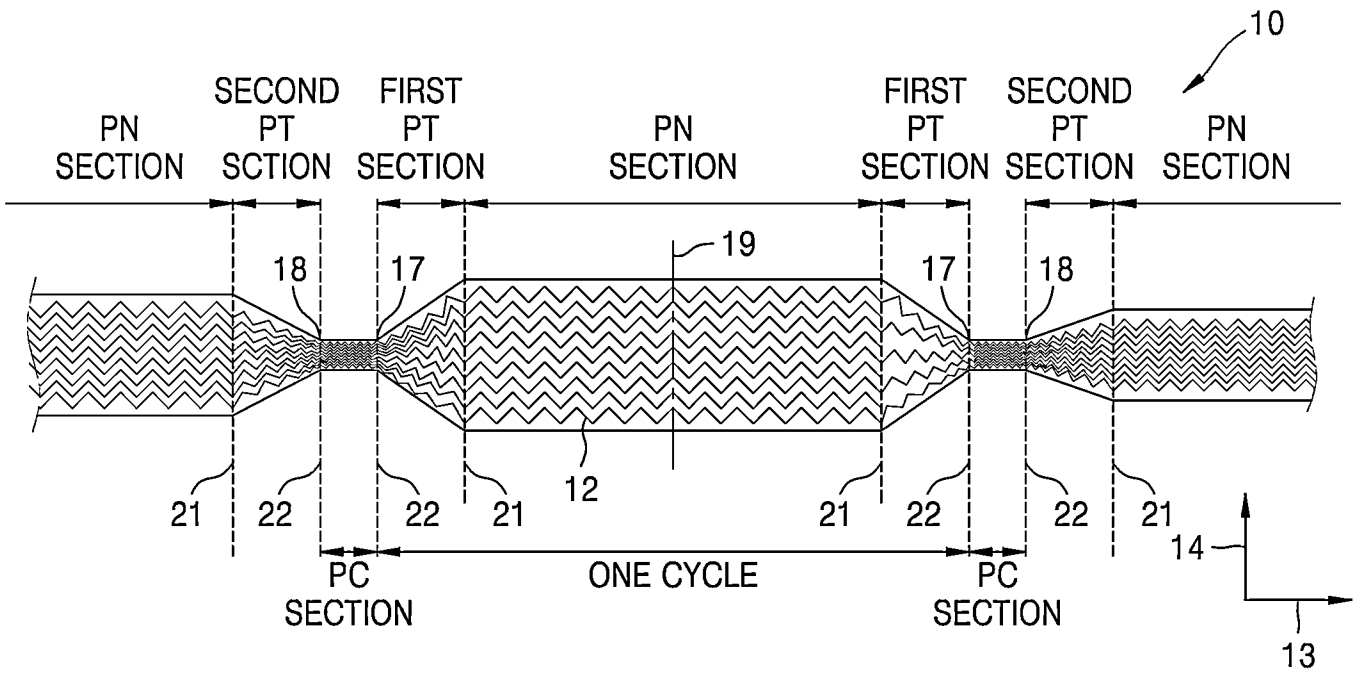
FIG. 1 is a schematic cross-sectional view of a continuous strand for a wig having a multistep-pencil tapering (MS-PT) effect according to an embodiment of the present disclosure.

FIG. 1 is a schematic cross-sectional view of a continuous strand in the form of simple strand 10 for a wig having a multi step-pencil tapering (MS-PT) effect according to an embodiment of the present disclosure. Referring to FIG. 1, the simple strand 10 spread to form a straight line is in a form that is extended in a longitudinal direction 13. In the following description, "longitudinal direction" 13, "machine direction (MD)", and "X direction" are used to mean the same, and "cross machine direction (CMD)" 14 indicates a direction perpendicular to the longitudinal direction 13 or the MD. The simple strand 10 has an appearance formed by aggregation of a plurality of filaments 12, that is, typically monofilaments or multifilaments, by rotational twisting basically produced by rotation, and is extended in the longitudinal direction 13.

The filaments are not particularly limited, but may include polyvinyl chloride (PVC), polyvinylidene chloride (for example, trade name MODACRYL), polyacrylonitrile (PAN), an acrylic resin, polycarbonate (PC), polymethyl methacrylate (PMMA), polystyrene (PS), an acrylonitrile-butadiene-styrene (ABS) resin, polyester, a styrene-acrylonitrile (SAN) resin, an acrylonitrile-styrene-acrylate (ASA) resin, polyacrylate (PAR), a polyester resin, polyphenylene sulfide (PPS), or a polymer alloy of two or more polymers listed above. The polymer alloy may be, for example, an alloy of PC/ABS, PC/polyethylene terephthalate (PET), or PC/PMMA.

A continuous strand for a wig having an MS-PT effect according to another embodiment of the present disclosure is not limited to these simple strands, and may be in a form of a composite strand, which has an appearance formed by cross-twisting produced by revolution and/or braiding of a plurality simple strands 10, and is extended in the longitudinal direction 13.

Figure 2A:
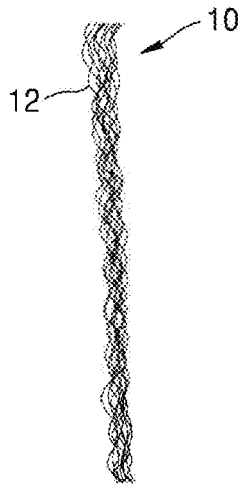
FIG. 2A is a schematic diagram of a simple strand specifically shown in FIG. 1.
Figure 2B:
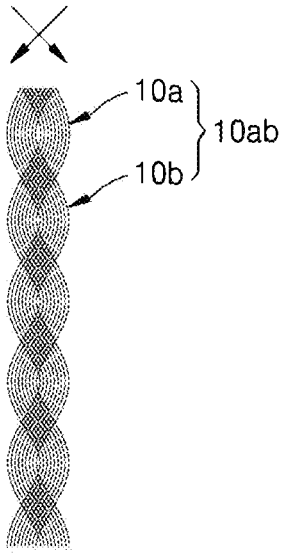
FIG. 2B is a schematic diagram of a composite strand formed by cross-twisting of two simple strands interlacing each other in two directions that intersect.
Figure 2C:
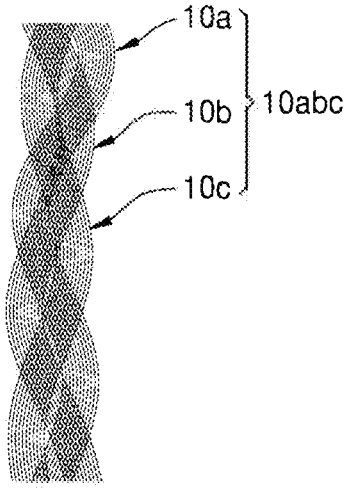
FIG. 2C is a schematic diagram of a composite strand formed by braiding of three simple strands.

FIGS. 2(A), 2(B), and 2(C) are diagrams schematically showing differences of structures of a simple strand 10 (FIG. 2(A)) specifically shown in FIG. 1; a composite strand 10*ab* (FIG. 2(B)) formed by cross-twisting of two simple strands 10*a*, and 10*b*, which are as shown in FIG. 1, interlacing each other in a direction that intersects (for example, as indicated by two arrows intersecting each other shown in FIG. 2(B)); and a composite strand 10*abc* (FIG. 2(C)) formed by braiding of three simple strands 10*a*, 10*b*, and 10*c*. FIGS. 2(A), 2(B), and 2(C) conceptually show only a portion in the longitudinal direction of these strands, in order to facilitate understanding of the structural difference between the simple strand and the composite strand mentioned above. That is, the composite strands of the forms shown in FIGS. 2(B) and 2(C) as a whole have a structural feature of repetitive PN section-first PT section-PC section-second PT section, which has as MS-PT effect described below taking the simple strand 10 shown in FIG. 1 as an example. In addition, empty spaces are shown to exist in FIGS. 2(A), 2(B), and 2(C), but in reality, these spaces are generally invisible to the naked eye.

Figure 3:
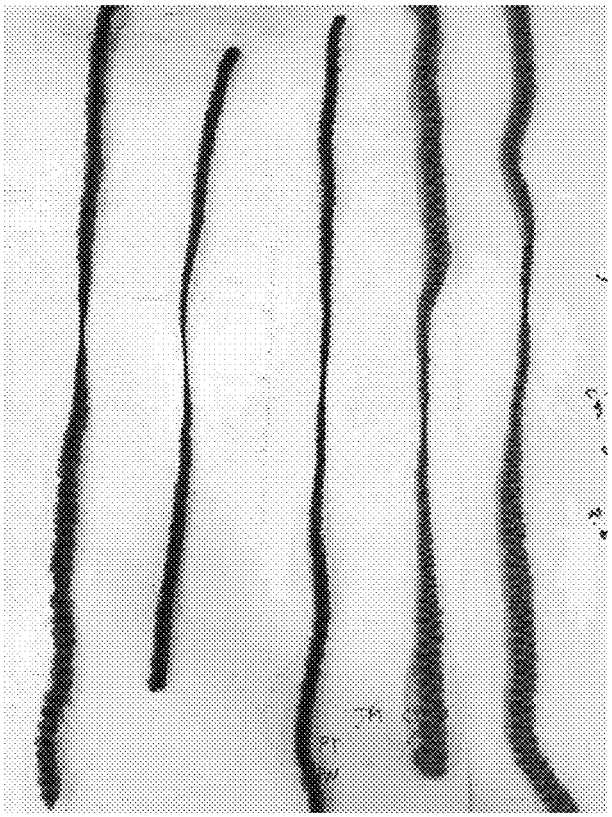
FIG. 3 is a photograph of the real composite strands formed by braiding of three simple strands.

FIG. 3 is a picture of the real composite strand 10*abc* formed by braiding of three simple strands 10*a*, 10*b*, and 10*c*. Referring to FIG. 3, it may be confirmed that this composite strand has the structural feature of the repetitive PN section-first PT section-PC section-second PT section-shown in FIG. 1, as a whole.

Figure 4:
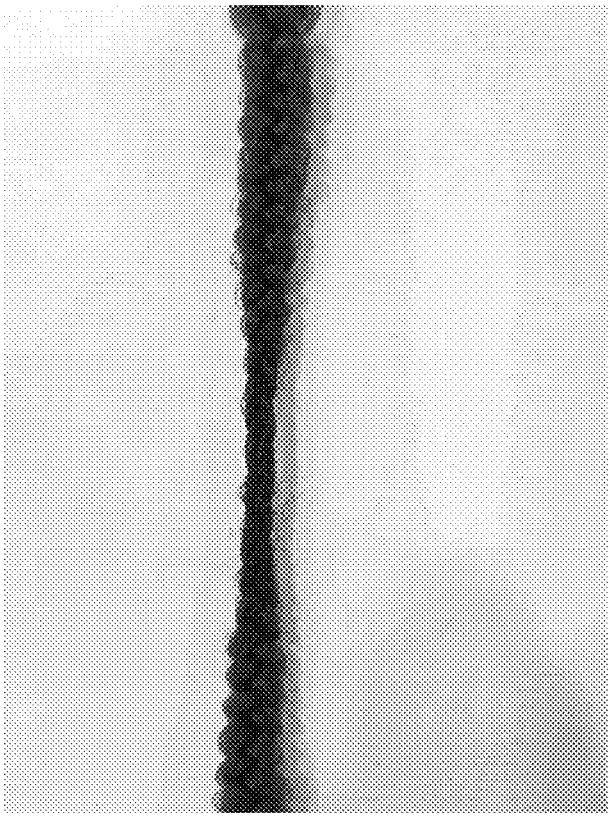
FIG. 4 is a close-up photograph of sections exhibiting a pencil tapering effect (PTE) of the composite strand shown in FIG. 3, that is, a first PT section, a second PT section, and a PC section connecting the first PT section and the second PT section.

FIG. 4 is a close-up photograph of a section exhibiting a pencil tapering effect (PTE) of the composite strand in the composite strand shown in FIG. 3, that is, a first PT section, a second PT section, and a PC section connecting the first PT section and the second PT section.

Referring to FIG. 1 again, each of the simple strand 10 and the composite strand (FIGS. 2(B) and 2(C)) includes: a pencil normal (PN) section extending along the longitudinal direction and having a first cross-sectional area of a constant size; two first pencil tapering (PT) sections respectively extending from both ends where the PN section ends and are tapered in such a way that cross-sectional areas decrease; two second PT sections respectively extending from ends of the two first PT sections having decreased cross-sectional areas and are tapered in such a way that the decreased cross-sectional areas increase again; and two pencil connection (PC) sections (connecting sections of PT-PN-PT repeating unit sections) connecting the first PT section and the second PT section that are adjacent to each other, and having a second cross-sectional area of a constant size. Therefore, the continuous strand for a wig according to the present disclosure has a characteristic of having sections with an inclined-thickness, that is, a pencil tapering (PT) effect repeated symmetrically, by repeatedly having the PN section and the first and second PT sections in the longitudinal direction 13, that is, MD.

When a section of bilateral symmetry consisting of the PN section and the two first PT sections respectively linked to both ends of the PN section is set as one cycle, the simple strand 10 repeatedly includes two or more multiple cycles, each of the one cycles which are adjacent to each other is connected by the PC section, and a first cross-sectional area of the PN section is larger than a second cross-sectional area of the PC section.

In each of the simple strand and the composite strands, a plurality of one cycles of one type or two or more types may be alternately repeated. For example, two first or second PT sections may be connected symmetrically at both ends of the PN section of a first thickness to form one cycle, and then another one cycle having the PN section of the same first thickness may be repeated; or following the one cycle described above, another one cycle may be connected thereto in which two first or second PT sections respectively are symmetrically connected at both ends centered on a PN section having a second thickness different from the first thickness. For another example, when only thicknesses of the PN sections are displayed, a sequence of thickness A-thickness B-thickness A; a sequence of thickness B-thickness A-thickness B; a sequence of thickness A-thickness B-thickness C; or a sequence of thickness A-thickness B-thickness B-thickness A may be repeated. Adjacent one cycles may be connected to each other by a PC section.

The simple strand and each of the simple strands constituting the composite strand may include 40 to 4,000 filaments 12 of one type or two or more types, wherein each of the filaments includes an amorphous organic polymer, a semi-crystalline organic polymer, or a polymer alloy thereof.

Each of the filaments 12 preferably has a thickness of 30 denier to 180 denier. The simple strand and the composite strands may consist only of filaments made of one type of polymer components selected from an amorphous organic polymer, a semi-crystalline organic polymer, or a polymer alloy thereof. When at least one of a chemical structure and a heat shrinkage rate of the polymer constituting the filaments included in the strand is different, the filaments are regarded as different types of filaments. For example, even when filaments A and B are composed of polymers having the same chemical structure (for example, PVC), when heat shrinkage rates of the polymers constituting filaments A and B are different, the strand including filaments A and B is considered to be composed of two types of filaments.

Each of the simple strand 10 and the composite strands (FIGS. 2(B) and 2(C)) has at least one cross-sectional shape selected from a circular shape; an oval shape; or a polygonal shape selected from triangles, quadrilaterals, and pentagons, and when the cross-section is circular or oval, its diameter or longest diameter is in a range of 0.2 cm to 3.0 cm; and when the cross-section is a polygon, a length of at least one side of the polygon is in a range of 0.2 cm to 3.0 cm.

When a part of the one cycle, including all or part of the PN section of the one cycle and having only one first PT section, is cut to separate the part of the one cycle from the simple strand 10 and the composite strands (FIGS. 2(B) and 2(C), and when lengths of the filaments separated in this manner are measured in the longitudinal direction while maintaining textures and waves imparted to the separated filaments, a difference Ld between a length of the longest filament Lmax and a length of the shortest filament Lmin, and a length Lpt of the first PT section included in the part of the separated one cycle are not equal to each other.

Each of cross-sectional areas of the PN sections included in the center of each one cycle included in the two or more multiple cycles may be the same as or different from each other.

When a part of the one cycle, including all or part of the PN section of the one cycle and having only one first PT section, is cut to separate the part of the one cycle from each of the simple strand and the composite strand, and when lengths of separated filaments 12 are measured in the longitudinal direction 13 while maintaining textures and waves imparted to the filaments 12 separated in this way, the filaments 12 may have the same or substantially the same lengths.

When the PN section, the first PT sections, or the second PT sections each are cut to separate them from the simple strand and the composite strand, and straight lengths of the filaments are measured in the longitudinal direction while maintaining textures and waves imparted to the filaments, the lengths of the filaments in each section separated in this way may be the same or substantially the same as each other; or may have 2, 3, or 4 length groups different from each other.

The above-described structural morphological characteristics of the continuous strand according to the present disclosure are fundamentally different from a tapering structure of the cross-sectional area (bundle thickness) in the longitudinal direction introduced into a bundle of filaments by the existing method of non-alignment by using a hackle.

As at least one of rotational twisting, cross-twisting, and raiding acting on a unit length of each of the simple strand and the composite strand increases, gradient tension increasing in a direction perpendicular to the longitudinal direction 13 is applied to each of the simple strand and the composite strand, and due to a resulting shrinkage control effect, each of the simple strand and the composite strand may have gradient cross-sectional areas that decrease toward tips of the first and second PT sections and become thinner. That is, as rotational twisting (twisting by rotation), cross-twisting (twisting by revolution), and/or braiding increase, gradient tension increasing in the direction 14 perpendicular to the longitudinal direction 13 is applied to each of the simple strand and the composite strand, and due to the resulting shrinkage control effect, each of the simple strand and the composite strand may have a thickness reduced toward tips of the first and second PT sections, and become thinner with an inclination. In another embodiment, a sum of rotational twistings (twisting by rotation), cross-twistings (twisting by revolution), and braiding acting on a unit length of each of the simple strand and the composite strand at the tips of the first and second PT sections may be controlled to be 1.2 times to 5.5 times, preferably 1.5 times to 4.0 times greater than a sum of rotational twistings (twisting by rotation), cross-twistings (twisting by revolution), and braiding acting on a unit length of each of the simple strand and the composite strand in the first and the second PN sections, for aesthetic benefits (in this regard, rubbing locks (RLs), which are locks formed by rotational twisting, cross-twisted locks (CTLs), and braiding locks (BLs) portions formed at the tips of the first and second PT sections are excluded).

The plurality of the first and second PT sections connected to the plurality of the PN sections are produced by gradient shrinkage (GS) of the filaments 12 in the longitudinal direction 13, and due to the gradient shrinkage, at least one of the following may be expressed: gradient thickness (GT) or gradient denier (GD) in which a thickness (denier) of the filaments 12 decreases in the first PT section and increases in the second PT section along the longitudinal direction 13; and gradient porosity (GP) in which porosity, which is a void volume ratio existing between the filaments, decreases in the first PT section and increases in the second PT section along the longitudinal direction 13.

The plurality of first and second PT sections connected to the plurality of PN sections are produced by gradient shrinkage (GS) of the filaments 12 in the longitudinal direction 13, and due to the gradient shrinkage, only the gradient thickness (GT or GD) of the filaments 12 may be expressed such that a thickness (denier) of the filaments may decrease in the first PT section and increase in the second PT section along the longitudinal direction 13.

The plurality of first and second PT sections connected to the plurality of PN sections may be produced by gradient shrinkage (GS) of the filaments in the longitudinal direction, and, only the gradient porosity (GP) may be expressed such that, porosity, which is a void volume ratio existing between the filaments 12, may decrease in the first PT section and increase in the second PT section along the longitudinal direction 13.

A sum of rotational twistings, cross-twistings, and braidings acting on a unit length of each of the simple strand and the composite strand at the tips 17, and 18 of the first and second PT sections may be 1.2 times to 5.5 times, preferably 1.5 times to 4.0 times greater than a sum of rotational twistings, cross-twistings, and braidings acting on a unit length of each of the simple strand and the composite strand in the PN section, in terms of aesthetics (in this regard, RLs, CTLs, and BLs portions formed at the tips of the first and second PT sections are excluded).

A porosity of the PN section, and the first and second PT sections may be calculated as a ratio of real density to bulk density (RD/BD), in this regard, the RD/BD ratio of the PN section may be 1.5 to 30, preferably 3 to 30, 2 to 20, 5 to 15, or 7 to 20, in terms of aesthetics.

The RD/BD ratio of the PN section may be 1.2 times to 10 times, preferably 1.5 times to 4 times, 1.5 times to 10 times, 1.8 times to 8 times, or 1.8 times to 5 times greater than the RD/BD ratio of the first and second PT sections, in terms of aesthetics (in this regard, RLs, CTLs, and BLs portions formed at the tips 17 and 18 of the first and second PT sections are excluded).

"Real density" is synonymous with "true density" or "absolute density", and "bulk density" is synonymous with "apparent density" or "volumetric density" and has a well-known meaning in the field of science and technology. The ratio of real density to bulk density (RD/BD) may be evaluated as follows.

(1) Measurement of Bulk Density

A sample of the corresponding section to be measured is appropriately cut from the strand to measure a weight thereof, and a length, width, and thickness thereof are measured to measure an apparent volume. In this regard, when measuring the length, width, and thickness, minute curves in the sample are ignored and the sample is measured based on the outline thereof. From the measured weight and apparent volume, bulk density of the sample is obtained by following equation:

Bulk density=weight/apparent volume.

(2) Measurement of Real Density

For the sample, a real density of the sample is measured by using the pycnometer method using helium gas by using a real density measuring device (AutoPycnometer 1320 manufactured by Micromeritics).

(3) Measurement of Ratio of Real Density/Bulk Density (RD/BD)

The ratio is obtained by dividing the real density value obtained above by the bulk density value.

The PN section may show a three-dimensional shape of a cylinder, an elliptical cylinder, a rectangular prism, or a pentagonal prism, and the first and second PT sections may show a three-dimensional shape of a truncated cone having a circular cross-section of the cylindrical PN section as a base, an elliptical truncated cone having an elliptical cross-section of the PN section having an elliptical cylinder shape as a base, frustum of quadrangular pyramid having a rectangular cross-section of the PN section having a rectangular prism shape as a base, or frustum of pentagonal pyramid having a pentagonal cross-section of the PN section having a pentagonal prism shape as a base.

Figure 5:
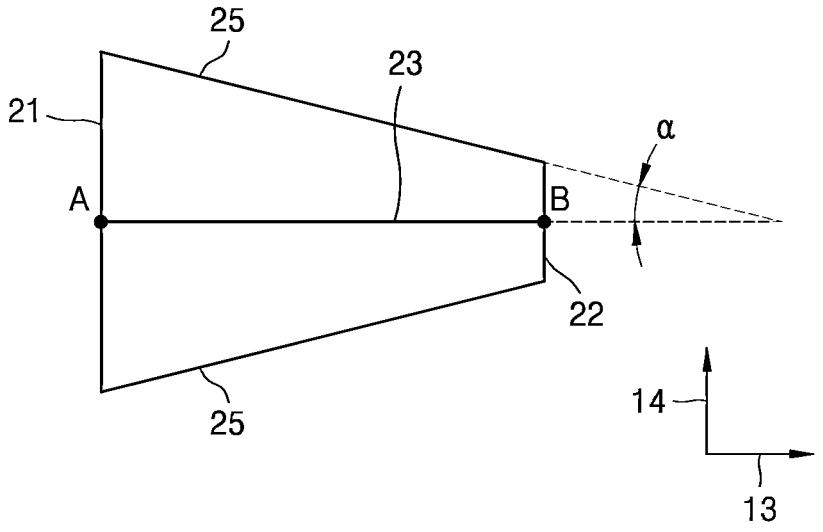
FIG. 5 is a schematic side view in which the first or second PT section of the linearly stretched continuous strand schematically shown in FIG. 1 is cut-away.

FIG. 5 is a schematic side view in which only the first or second PT section of the linearly stretched simple strand 10 schematically shown in FIG. 1 is cut-away. Referring to FIG. 5, a center line 23 formed by connecting a midpoint A of a line segment 21, which indicates a base side of the truncated cone, the elliptical truncated cone, the frustum of quadrangular pyramid, or the frustum of pentagonal pyramid, to a midpoint B of a line segment 22, which indicates an upper side (17 or 18 of FIG. 1) of the truncated cone, the elliptical truncated cone, the pentagonal pyramid, the frustum of quadrangular pyramid, and the frustum of pentagonal pyramid, in the longitudinal direction may form an angle $\alpha$ with any one of hypotenuses 25 of the truncated cone, the elliptical truncated cone, the frustum of quadrangular pyramid, or the frustum of pentagonal pyramid of 0.3° to 45°, for example, 0.3° to 30°, 0.5° to 25°, 1° to 25°, or 1.5° to 25°. In addition, in the side view of the first or second PT section, a length of the center line, formed by connecting the midpoint A of the line segment 21 indicating the base side of the first or second PT section to the midpoint B of the line segment 22 indicating the upper side, may be adjusted to 1 cm to 50 cm, in terms of aesthetics.

The side view shown in FIG. 5 may be obtained from a photograph obtained by observing the strand focused on the first or second PT section by using scanning electron microscopy (SEM) or an optical microscope.

The angle, which is a measure of an inclination of the PT section, may be adjusted by a degree of length shrinkage (LS) and/or texture shrinkage (TS) of the filaments generated by controlling an extent of at least one selected from rotational twisting (RT), cross-twisting (CT), and braiding applied to the filaments during the manufacturing process.

The reduction in cross-sectional area in the first PT section is a result of a decrease in porosity between the filaments constituting each of the simple strand and the composite strand and/or a decrease in a thickness of the filaments, and in the first and second PT sections, each of the simple strand and the composite strand may be in a solid form in which the center portion is not empty, not a hollow form in which the center is empty. That is, the continuous strand according to the present disclosure is distinguished from a strand form in which a core portion is hollow by winding a filament bundle around a mold having an inclined-thickness, for example, an arrowhead-shaped curl pipe, and then heat-setting according to a conventional technology in the art.

The continuous strand may be axisymmetric relative to a virtual line (a position '19' in FIG. 1) cut perpendicular to the longitudinal direction 13 at the midpoint of the PN section ('19' in FIG. 1).

Each of the simple strand and the composite strand may have a length of 1 m or more. A length of the PN section may be in a range of 5 cm to 200 cm, lengths of the first and second PT sections each may be in a range of 1 cm to 50 cm, and a length of the PC section may be in a range of 0.3 cm to 5 cm.

Each of the simple strand and the composite strand may be in a form that is cut to a predetermined length in a direction perpendicular to the longitudinal direction. Specifically, in FIG. 1, the strand may be commercialized by cutting the strand 10 in a form, in which the PN section and two first or second PT sections respectively connected to both ends thereof are continuously formed, along the dotted line 22 perpendicular to the longitudinal direction 13. In this case, the wearer may fold the strand product obtained by the cutting in half at a center line 19 of the PN section, and then connect the filaments of this part to real hairs of the scalp so that the tip 17 or 22 of the first or second PT section drapes in the direction of the ground. Alternatively, the strand may be commercialized in a form cut at the center line 19 of the PN section, and consisting of a half of the PN section and one first or second PT section. In this case, the wearer may connect the filaments of a portion at the center line 19 of the cut PN section to real hairs of the scalp so that the tip 17 or 22 of the first or second PT section drapes in the direction of the ground.

When a finished wig product, obtained by cutting each of the simple and complex strands of the present disclosure in a constant length in the CMD perpendicular to the longitudinal direction, is released on the market, the tips of the first and second PT sections may be in a state in which rubbing locks (RLs), cross-twisted locks (CTLs), or braiding locks (BLs) are formed; or hot drawing (HD) or curling treatment is performed to the tips, or the filaments at the tips may be in a state in which they are not locked, and are loosened without being constrained to each other.

A wig according to another aspect of the present disclosure may be manufactured by using the continuous strand for a wig described above. For example, the continuous strands of the present disclosure may be used in manufacturing a weft for making wigs. The weft includes a connecting band extended in one direction; and a plurality of strands having one ends connected to the connecting band, wherein the one ends of the strands are sequentially connected to a side of the connecting band along a direction the connecting band is extended, wherein the strand may be the above-described continuous strand for a wig of the present disclosure. That is, a wig according to another aspect of the present disclosure may include a strand according to an aspect of the present disclosure or a weft of the above-described configuration.

The continuous strand for a wig according to the present disclosure having the above-described structural features may be continuously mass-produced by an automatic control method by using a programmable logic controller (PLC), in which heat application points and duration time, in consideration of tension, a filament shrinkage rate, and a glass transition temperature (Tg), are programmed to make the PN section thicker to form the first and second PT sections, and make the first and second PT sections relatively thinner while being increasingly/decreasingly tapered, instead of using a hackle non-alignment manual operation. Specifically, as a method of producing a strand having an MS-PT effect, the following method may be employed.

First, a degree of rotational twisting (RT), cross-twisting (CT), and/or braiding corresponding to partial tension in CMD perpendicular to the longitudinal direction of the strand, and a temperature applied to the strand are controlled by PLC automatic control by setting a gradient condition of an increase and decrease, in order to induce PT repeatedly at certain parts of the strand (at regular intervals), and thus, an MS-PT effect may be produced. At this time, by performing heat shrinkage treatment while repeatedly applying physical tension of rotational twisting, cross-twisting and/or braiding to the strand normally or with tapering, a strand having a PN section of a constant thickness and first and second PT sections of a tapered thickness may be produced. For example, by controlling shrinkage rates of filaments constituting the strand to be tapered in the first PT section, through adjustment of physical energy applied to the strand, that is, an amount of heat (heating temperature, application time), tension, and a compressive force, that is, by controlling the shrinkage rates to become smaller (downward tapering) and to become greater again in the second PT section (upward tapering), it is possible to continuously form inclined-thickness sections of the strand symmetrically in the longitudinal direction of the strand at regular intervals. In this regard, an amount of heat that greatly affects the shrinkage rates of the filaments that induce the PT section may be controlled by a heat source temperature and heat source application time, and a force for controlling the shrinkage rates to be tapered is tension in MD, vertical pressure (compression force) in CMD of the strand, etc., and degrees thereof may be controlled by an automatic control device, and thus, desired PT characteristics may be obtained.

When a lot of rotational twistings or cross-twistings are applied to the strand being manufactured, the strand should become thicker, but on the contrary, the tension applied in the direction of CMD increases, limiting a degree of shrinkage freedom and gradually thinning the strand (hereinafter referred to as 'inversion phenomenon'). By using the inversion phenomenon, it is possible to form a PT section by causing inclined-thickness shrinkage of the filaments, and gradient texture shrinkage (GTS), which is greater than the inclined-thickness shrinkage of the filaments.

Specific manufacturing processes may be largely divided into two. That is, the manufacturing process may be divided into (i) a process of applying an appropriate physical force of rotational twisting, cross-twisting, and/or braiding to the filaments spun and drawn in a previous process, and (ii) a process of applying heat to the strands of the filaments to which the physical force is applied (heat shrinkage process). In this regard, the process of applying rotational twisting, cross-twisting, and/or braiding to a strand made of a set of a certain amount of filaments or a plurality of strands, and the process of inducing heat shrinkage may be performed as a continuous process or may be performed in two steps. In this regard, when the heat shrinkage process is performed while changing the temperature of the heat chambers, it is necessary to have many heat chambers and it is difficult to control a length of the strand passing through the heat chamber section as subdivided as possible. Therefore, it is advantageous to control the degree of heat shrinkage by adjusting the residence time in the heat chamber maintained at a constant temperature. However, this method also has difficulty in controlling heat chamber sections where the strand stays as subdivided as possible, and it may be difficult to form the first and second PT sections unless the heat chamber sections are highly subdivided. Therefore, it is convenient to form the first and second PT sections through the control of the degree of freedom of shrinkage in the whole process while keeping the heat shrinkage temperature of the heat shrinkage chamber and residence time constant. That is, a force in CMD applied by controlling a number of rotational twistings (for simple strands), a number of cross-twistings (CTs), and/or a number of braidings per unit length, that is, one meter, is given a gradient in the sections that need to form the first and second PT sections, and thus, a gradient is induced in degrees of shrinkage freedom, and a continuous strand for a wig having the above-described structural features may be manufactured. In the first and second PT sections, not only the gradient shrinkage rate is controlled, but also gradient characteristics may be given to a thickness of the filaments constituting the strand after shrinkage, or the gradient characteristics may be simultaneously expressed.

In the manufacturing process of the continuous strand according to the present disclosure manufactured as described above, both the texture shrinkage (TS) and the thickness shrinkage of the filaments occur, but the PT effect is mainly dependent on the texture shrinkage. However, a product, in which rotational twisting, cross-twisting and/or braiding is reduced by performing heat stretching in both directions of the strand in the longitudinal direction to reduce a thickness of the filaments, in order to obtain a sharper end at the tips of the PT section of a finished wig product, is included in the strand according to the present disclosure. Furthermore, a product, which has a locked end by twisting, braiding, rubbing, etc., in addition to heat stretching, is also included in the strand according to the present disclosure.

Although specific embodiments and examples have been discussed, a person skilled in the art will understand that a scope of the claims extends beyond the specifically discussed embodiments to include other alternative embodiments and/or uses and obvious modifications and equivalents thereof.

What is claimed is:

1. A continuous strand extended in a longitudinal direction thereof, wherein the continuous strand is in a form of:

a simple strand that has rotational twisting produced by rotations of a plurality of filaments and is extended in the longitudinal direction; or a composite strand that has cross-twisting produced by revolutions of a plurality of simple strands, braiding, or cross-twisting and braiding the plurality of simple strands, the simple strand, and each of the plurality of simple strands constituting the composite strand, comprises 40 to 4,000 filaments made of one or more types of polymer components selected from an amorphous organic polymer, a semi-crystalline organic polymer, or a polymer alloy thereof, each of the simple strand and the composite strand has a cross-sectional shape of a circular shape, an oval shape, and a polygonal shape selected from a triangle, a quadrangle, and a pentagon, and when the cross-section shape is circle or oval, a diameter of the circle or a longest diameter of the oval is in a range of 0.2 cm to 3.0 cm, and when the cross-section shape is a polygon, a length of at least one side of the polygon is in a range of 0.2 cm to 3.0 cm, each of the simple strand and the composite strand further comprises:

a pencil normal (PN) section extending along the longitudinal direction thereof and having a first cross-sectional area of a constant size;

two first pencil tapering (PT) sections respectively extending from both ends where PN section ends and are tapered in such a way that cross-sectional areas decrease;

two second PT sections respectively extending from an end of one of two pencil connection (PC) sections each having a second cross-sectional area of a constant size which is smaller than the first cross-sectional area, wherein each of the two second PT sections is tapered in such a way that its cross-sectional area increases from the second cross-sectional area again; and the two pencil connection (PC) sections each connecting one of the first PT sections and one of the second PT sections that are adjacent to each other, when a section of bilateral symmetry including the PN section and the two first PT sections respectively linked to both ends of the PN section is set as one cycle, each of the simple strand and the composite strand repeatedly comprises two or more multiple cycles, each of the one cycles which are adjacent to each other is connected by the PC section, and when a part of the one cycle, having only one first PT section and including all or part of the PN section of the one cycle, is cut to separate the part of the one cycle from each of the simple strand and the composite strand, and lengths of the filaments thus separated are measured in the longitudinal direction while maintaining textures and waves imparted to separated filaments, a difference Ld between a length of a longest filament Lmax and a length of a shortest filament Lmin, and a length Lpt of the first PT section included in the separated part of the one cycle are not equal to each other, wherein the continuous strand is used for making a wig.

2. The continuous strand of claim 1, wherein each of cross-sectional areas of the PN sections comprised in each one cycle comprised in the two or more multiple cycles is the same as or different from each other.

3. The continuous strand of claim 1, wherein:

when a part of the one cycle, having only one first PT section and including all or part of the PN section of the one cycle, is cut to separate the part of the one cycle from each of the simple strand and the composite strand, lengths of the filaments thus separated are measured in the longitudinal direction while maintaining textures and waves imparted to the filaments, and the filaments have the same length with each other.

4. The continuous strand of claim 1, wherein when:

the PN section, the first PT sections, or the second PT sections are respectively cut to separate them from each of the simple strand and the composite strand, and lengths of the filaments are measured in the longitudinal direction while maintaining textures and waves imparted to the filaments:

the lengths of the filaments in each section thus separated is the same as each other; or the filaments in each section thus separated have 2, 3, or 4 length groups different from each other.

5. The continuous strand of claim 1, wherein:

a plurality of the first and second PT sections connected to a plurality of the PN sections are produced by gradient shrinkage (GS) of the filaments in the longitudinal direction, and due to the gradient shrinkage (GS), at least one of the following is expressed: gradient thickness (GT) or gradient denier (GD) in which a thickness of the filaments decreases in the first PT section and increases in the second PT section along the longitudinal direction, and gradient porosity (GP) in which porosity, which is a void volume ratio existing between the filaments, decrease in the first PT section and increases in the second PT section along the longitudinal direction.

6. The continuous strand of claim 1, wherein a plurality of the first and second PT sections connected to a plurality of the PN sections are produced by gradient shrinkage (GS) of the filaments in the longitudinal direction, and due to the gradient shrinkage (GS), only a gradient thickness (GT) of the filaments is expressed such that a thickness of the filaments decreases in the first PT section and increases in the second PT section along the longitudinal direction.

7. The continuous strand of claim 1, wherein a plurality of the first and second PT sections connected to a plurality of the PN sections are produced by gradient shrinkage (GS) of the filaments in the longitudinal direction, and only gradient porosity (GP) is expressed such that porosity, which is a void volume ratio existing between the filaments, decreases in the first PT section and increases in the second PT section along the longitudinal direction.

8. The continuous strand of claim 1, wherein a sum of rotational twistings, cross-twistings, and braidings acting on a unit length of each of the simple strand and the composite strand at each tip of the first and second PT sections is 1.2 times to 5.5 times greater than a sum of rotational twistings, cross-twistings, and braidings acting on a unit length of each of the simple strand and the composite strand in the PN section excluding rubbing locks (RLs), cross-twisted locks (CTLs), and braiding locks (BLs) portions formed at tips of the first and second PT sections.

9. The continuous strand of claim 1, wherein a porosity of the PN section and the first and second PT sections is calculated as a ratio of real density to bulk density (RD/BD), the RD/BD ratio of the PN section is 1.5 to 30, and the RD/BD ratio of the PN section is 1.2 times to 10 times greater than the RD/BD ratio of the first and second PT sections excluding rubbing locks (RLs), cross-twisted locks (CTLs), and braiding locks (BLs) portions formed at tips of the first and second PT sections.

10. The continuous strand of claim 1, wherein:

the PN section shows a three-dimensional shape of a cylinder, an elliptical cylinder, a rectangular prism, or a pentagonal prism, and the first and second PT sections show a three-dimensional shape of a truncated cone having a circular cross-section of a cylindrical PN section as a base, an elliptical truncated cone having an elliptical cross-section of the PN section having an elliptical cylinder shape as a base, frustum of quadrangular pyramid having a rectangular cross-section of the PN section having a rectangular prism shape as a base, or frustum of pentagonal pyramid having a pentagonal cross-section of the PN section having a pentagonal prism shape as a base.

11. The continuous strand of claim 10, wherein, in a side view of the first and second PT sections, a center line formed by connecting in the longitudinal direction: a midpoint of a line segment, which indicates a base side of the truncated cone, the elliptical truncated cone, a frustum of quadrangular pyramid, or the frustum of pentagonal pyramid, to a midpoint of a line segment, which indicates an upper side of the truncated cone, the elliptical truncated cone, the frustum of quadrangular pyramid, or the frustum of pentagonal pyramid, forms an angle with any one of hypotenuses of the truncated cone, the elliptical truncated cone, the pentagonal pyramid, the frustum of quadrangular pyramid, or the frustum of pentagonal pyramid of 0.3° to 45°; and in the side view of the first and second PT sections, a length of the center line formed by connecting the midpoint of the line segment indicating the base side of the first and second PT sections to the midpoint of the line segment indicating the upper side, is 1 cm to 50 cm.

12. The continuous strand of claim 1, wherein the decrease in cross-sectional area in a first PT section is a result of a decrease in porosity between the filaments constituting each of the simple strand and the composite strand and/or a decrease in a thickness of the filaments, and in the first and second PT sections, each of the simple strand and the composite strand have a solid form where a respective center portion is not empty, unlike a hollow form having an empty center portion.

13. The continuous strand of claim 1, wherein the continuous strand is axisymmetric relative to a virtual line cutting in a direction perpendicular to the longitudinal direction at a midpoint of the PN section.

14. The continuous strand of claim 1, wherein each of the simple strand and the composite strand has a length of 1 m or more.

15. The continuous strand of claim 1, wherein each of the filaments has a thickness of 30 denier to 180 denier.

16. The continuous strand of claim 1, wherein:

a length of the PN section is in a range of 5 cm to 200 cm, a length of each of the first and second PT sections is in a range of 1 cm to 50 cm, and a length of the PC section is in a range of 0.3 cm to 5 cm.

17. The continuous strand of claim 1, wherein ethe simple strand, and the composite strand are in a form that is cut to a predetermined length in a direction perpendicular to the longitudinal direction.

18. A wig, comprising:

the continuous strand as defined in claim 1.

* * * * *